United States Patent [19]

Juenkersfeld et al.

[11] Patent Number: 4,860,926

[45] Date of Patent: Aug. 29, 1989

[54] ARRANGEMENT FOR DOSINGLY FILLING OF FLUID OR PASTY MATERIAL INTO CONTAINERS

[75] Inventors: Harald Juenkersfeld, Wuppertal; Georg Fischer, Velbert, both of Fed. Rep. of Germany

[73] Assignee: Benz & Hilgers BmbH, Duesseldorf, Fed. Rep. of Germany

[21] Appl. No.: 102,508

[22] Filed: Sep. 29, 1987

[30] Foreign Application Priority Data

Oct. 29, 1986 [DE] Fed. Rep. of Germany ..... 3636804

[51] Int. Cl.[4] ..... B65B 3/04

[52] U.S. Cl. ..... 222/148; 222/217; 222/309; 141/90; 141/258

[58] Field of Search ..... 222/148, 309, 333, 367–368, 222/372, 381, 217–218; 141/89–90, 258; 417/518–519

[56] References Cited

U.S. PATENT DOCUMENTS

| | | | |
|---|---|---|---|
| 3,583,603 | 6/1971 | Freckmann et al. | 222/381 X |
| 4,358,257 | 11/1982 | Seiler et al. | 417/517 |
| 4,667,709 | 5/1987 | Fischer et al. | 141/91 |
| 4,699,297 | 10/1987 | Raque et al. | 222/148 |

FOREIGN PATENT DOCUMENTS

| | | | |
|---|---|---|---|
| 0185958 | 11/1985 | European Pat. Off. . | |
| 6934 | 10/1973 | Fed. Rep. of Germany . | |
| 2502849 | 10/1975 | Fed. Rep. of Germany . | |
| 2732478 | 2/1979 | Fed. Rep. of Germany | 417/519 |
| 2852651 | 6/1980 | Fed. Rep. of Germany . | |
| 2645461 | 4/1981 | Fed. Rep. of Germany . | |
| 3010010 | 9/1981 | Fed. Rep. of Germany . | |
| 3412628 | 5/1986 | Fed. Rep. of Germany . | |
| 3636804 | 5/1988 | Fed. Rep. of Germany . | |

*Primary Examiner*—Michael S. Huppert

*Attorney, Agent, or Firm*—Klein & Vibber

[57] ABSTRACT

The invention relates to an arrangement for dosingly filling pasty or fluid filling material into containers. The arrangement is provided with a rotatably mounted cylinder and an axially slidably mounted piston which moves within the rotatable cylinder and which in its extreme inner position closes at least a third, but preferably about 50% of a window-like through opening, respectively inlet opening in the housing of the device. When retracting the dosing piston it exposes the portion of the through opening which has been closed when the piston is in its innermost position. By filling containers by means of the device of this invention, the filling material is automatically dropped into the rotating cylinder and is thereby subjected to an extraordinarily sparingly sensitive manipulation, which is particularly significant for sensitive products, such as for example salad-like products. Moreover, the dosing piston and the rotatable cylinder can be moved relative to each other into axially extreme positions so that a universal thorough rinsing of the various parts forming the assembly of the arrangement are made possible.

11 Claims, 2 Drawing Sheets

ARRANGEMENT FOR DOSINGLY FILLING OF FLUID OR PASTY MATERIAL INTO CONTAINERS

BACKGROUND OF THE INVENTION

This invention relates to an arrangement for dosingly filling fluid or pasty material into containers.

The arrangement of the invention for dosingly filling the pasty or fluid material includes a housing having an inlet and outlet opening for the filling material. A cylinder is rotatably mounted in the housing and alternately exposes the inlet and outlet openings. This rotatable cylinder is provided on its peripheral wall with a window-like through opening. This rotatable cylinder is mounted by way of a trunnion pin in a support part of the arrangement and is furthermore arranged coaxially to the axis of rotation of a dosing piston and this dosing piston is reciprocally slidably moved via a piston rod in a support part.

Such a dosing arrangement has been described in the co-assigned U.S. Pat. No. 4,667,709. In this known dosing arrangement the filling material is sucked via the action of a sucking stroke by the dosing piston via the inlet opening and the window-like through opening in the rotatable cylinder by way of a 90° deviation and by virtue of the fact that the rotatable cylinder closes the outlet opening.

With the then following expulsion step the filling material is again deviated 90° via the outlet opening through the dosing piston and is delivered via the outlet opening to a container. This filling procedure is suitable for certain products such as for example butter, margarine and the like.

However, with particularly sensitive filling materials, such as for example salads, dry cheese and the like, such a filling procedure is no longer suitable since the products are extremely sensitive to rough handling.

SUMMARY OF THE INVENTION

It is an object of this invention to provide an arrangement for dosingly filling of fluid or pasty filling material into containers of the afore-described type, which has a more compact construction than the prior art machine and simultaneously provides for a more sparing handling of the filling material. Moreover, this novel machine is simple to manufacture and assemble. A further object of the arrangement resides in providing for a good rinsing possibility in the machine which rinsing can be effected from all sides by means of a cleaning fluid.

The afore-mentioned objects are achieved in accordance with the invention by making the dosing piston slidably movable along the inner walls of the rotatable cylinder and assuring that the dosing piston is in its outward position, introduced by the piston rod at least so far into the rotatable cylinder that an exposed portion of the inlet opening remains in the longitudinal direction; thus at least a third of the window-like through-opening of the rotatable cylinder, respectively the inlet opening, is covered by means of the peripheral surface of the piston.

Thus, one achieves with the means provided by the arrangement of this invention a dosing arrangement by means of which, by way of the introduction of the dosing piston into the rotatable cylinder, the desired compact construction of the arrangement is achieved. Simultaneously, the window-like through opening, respectively inlet opening of the housing is blocked to such an extent by means of the introduced dosing piston that with the return stroke of the dosing piston the blocked, relatively large cross-section of the window-like through-opening, respectively the inlet opening is unblocked and exposed and thereby the filling material automatically drops down to the inner wall of the outlet opening of the closing rotatable cylinder which has been exposed by the dosing piston. In this fashion the heretofore required dual deviation of the filling material is dispensed with so that the filling operation of the inventive arrangement is particularly suitable for sensitive products, for example salad-like products or generally speaking, for dry, respectively fat-poor filling material.

An advantageous construction of the arrangement of the invention provides that in an extreme inner position of the piston rod relative to the housing the peripheral surface of the dosing piston covers about half of the through opening, respectively inlet opening, and that in this inward position the free end face of the dosing piston is positioned within the region defined by the edges of the through opening and the inlet opening, which is approximately of the same size. By means of the predetermined maintained relationship of the dimensions and operational paths of the dosing piston and rotatable cylinder there is assured that a relatively large amount of the filling material is first held back by the dosing piston and is only released at the retraction thereof into the unblocking position. Since in this fashion the end face of the dosing piston reciprocates a relatively large distance to travel relative to the inner bottom wall of the rotatable cylinder, there is also immediately achieved a supporting sucking effect for the filling material which falls down. Simultaneously with the outward movement of the dosing piston there is achieved that by the relatively large distance traveled by the end face of dosing piston with respect to the bottom surface of the rotatable cylinder the filling material is not crushed, respectively compressed, which is of particular advantage with respect to salad-like products.

Furthermore, it has proven to be advantageous for the cross-section of the through opening and thereby also the inlet opening to be larger than the cross-section of the dosing piston. Here too, an optimum large volume filling of the filling material is assured. On the other hand, the end face of the dosing piston is advantageously about the same size as the outlet opening. Thereby there is assured that the filling material is supplied in exactly measured dosing amount in a flawfree manner into the containers.

The mounting of the rotatable cylinder, which has advantageously conically shaped mounting surfaces, which in the region of the support elements are cylindrical is effected via a synthetically coated mounting ring in the housing, so that on the one hand, an exact mounting, and on the other hand, a good sealing at the mounting region is achieved.

The filling arrangement of the invention can be claimed by means of a rinsing circulating fluid in a particularly simple manner. Thus, when the rotatable cylinder is moved from a production position, in which it coacts with the dosing piston, which is a first control position, into a cleaning position, which is a second control position, by axial adjustment, the rotatable cylinder is disposed in the cleaning position. In this latter position about one quarter of the length of the cylinder is disposed within the support part confronting the feed conduit and outlet conduit for the through flow of the cleaning fluid. In this latter position the rotating cylinder has no longer any kind of communication for the through flow of cleaning fluids and at the free end theeof which faces away from the trunnion pin with a retracted dosing piston.

Insofar as when the dosing piston with the inwardly moved piston rod is disposed substantially within the support part that is provided with the feed conduit and outlet conduit for the cleaning fluid and the rotatable cylinder and the dosing piston are surrounded by their corresponding support parts, there results a universal and very good rinsing action of all parts forming the assembly without requiring any disassembly thereof. The filling arrangement thus distinguishes itself in addition to a simple and compact construction by means of a very good and thorough cleaning and rinsing action.

BRIEF DESCRIPTION OF THE DRAWING

With these and other objects in view, which will become apparent in the following detailed description, the present invention will be clearly understood, in connection with the accompanying drawings, in which.

DETAILED DESCRIPTION

Figure 1:
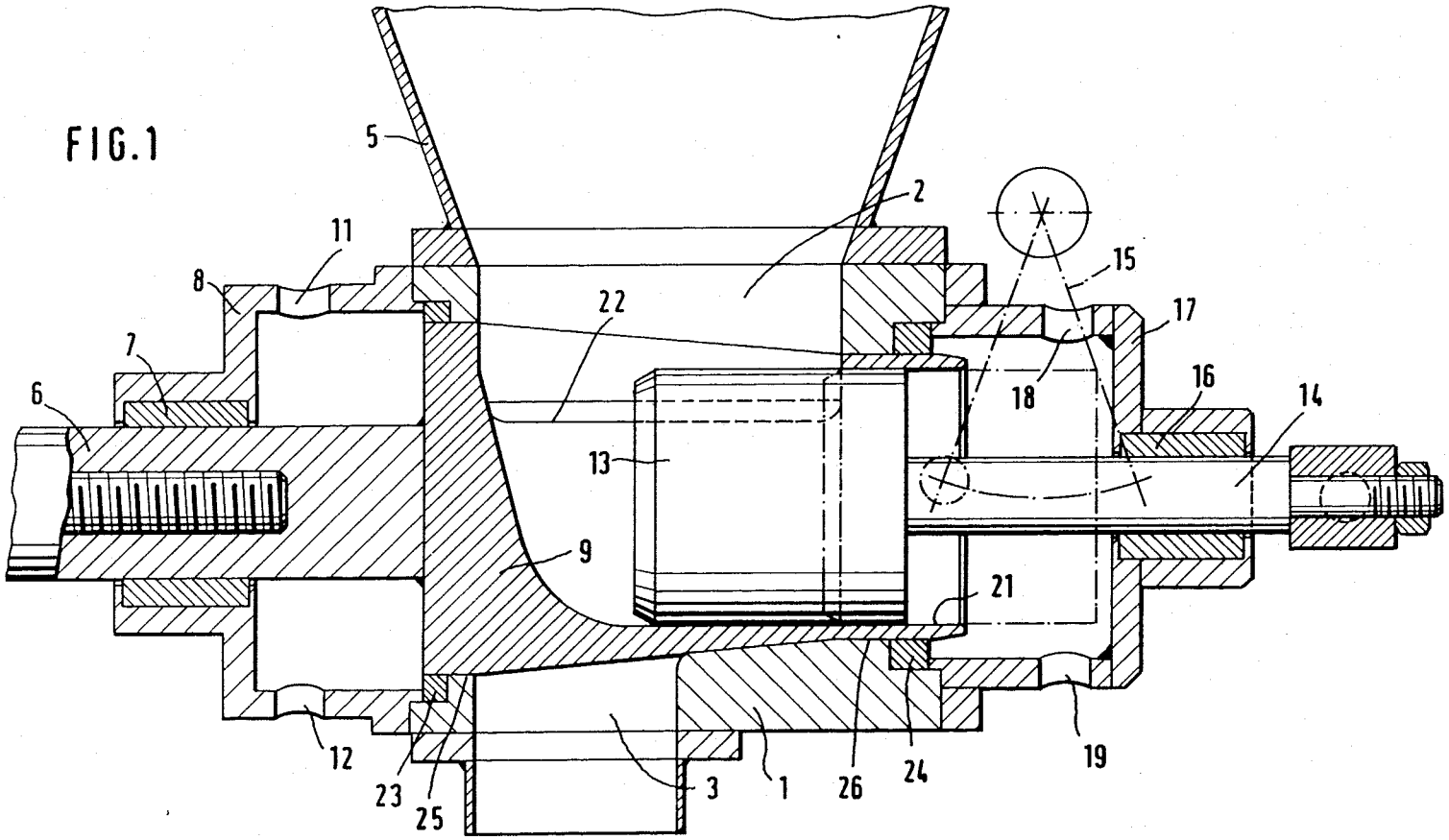
FIG. 1 is a longitudinal cross-sectional view of a filling arrangement shown in the production position.

As can be noted from FIG. 1 the fluid, respectively pasty filling material for dosingly filling, in particular salad-like products, dry cheese or the like, is used in conjunction with a suitable arrangement which comprises a housing 1 having an inlet opening 2 of relatively large cross-section as well as an outlet opening 3 of a relatively smaller cross-section. The funnel-like conduit 5 may be connected to the inlet opening 2, whereas the outlet opening 3 can be provided with a non-illustrated mouth piece for filling containers.

There is axially slidably mounted in the housing 2 a rotatable cylinder 9 via a trunnion pin 6 and a bearing ring 7. This rotatable cylinder 9 is axially slidably and rotatably mounted in a manner not illustrated in detail in the support 8. The support 8 is provided with a feed conduit 11 and an outlet conduit 12 for a cleaning fluid for functions that will be described hereinafter.

A dosing piston 13 is coaxially mounted with respect to the rotatable cylinder 9, which dosing piston 13 is slidable via a piston rod 14 within the rotatable cylinder 9. This piston rod 14 is slidably guided via an actuating mechanism 15 (only schematically illustrated) in a sleeve 16 which is threadably mounted in the housing 1. The support 17 has also an inlet opening 18 and an outlet opening 19 for a cleaning fluid.

The piston 13 is in addition slidably mounted along the inner wall 21 of the rotatable cylinder 9. The rotatable cylinder 9 possesses furthermore a window-like through opening 22 which is substantially of the same size as the inlet opening 2 of the housing 1. For mounting the rotatable cylinder 9 within the housing 1 there are provided the bearing rings 23, 24, which coact at all times with the cylindrical guide surfaces 25, 26 of the outer peripheral surface of the rotatable cylinder 9 and thereby serve as bearing supports for the rotatable cylinder and for sealing the same relative to the housing.

By means of the aforedescribed manner of sealing and mounting of the bearing rings the conical portion of the rotatable cylinder 9 needs not to be very exactly machined.

MANNER OF OPERATION OF THE FILLING ARRANGEMENT

The filling arrangement is illustrated in its production position in FIG. 1, that means the rotatable cylinder 9 is located in the position illustrated in full lines in FIG. 1. In this extreme position the dosing piston 13 closes about 50% in a longitudinal direction of the window-like through opening 22, respectively the inlet opening 2, so that the filling material is prevented from falling down in this portion of the device. As soon as the dosing piston 13 has been retracted by way of the piston rod 14 into the position illustrated in the dot-dash line, the filling material falls into the inner space of the rotatable cylinder. It is prevented from exiting therefrom to the outlet opening 3 by means of the wall of the rotatable cylinder. After the rotatable cylinder 9 has been rotated about 180°, the filling material disposed within the rotatable cylinder is pushed out via the outlet opening 3 in cooperation with the now again inwardly moving dosing piston 13 and thereby the container is filled via the filling mouth of the arrangement. Thereafter, there results again a retraction of the dosing piston 13, whereby the filling material again drops down and such movement is simultaneously supported by means of a sucking action engendered by the dosing piston.

Figure 2:
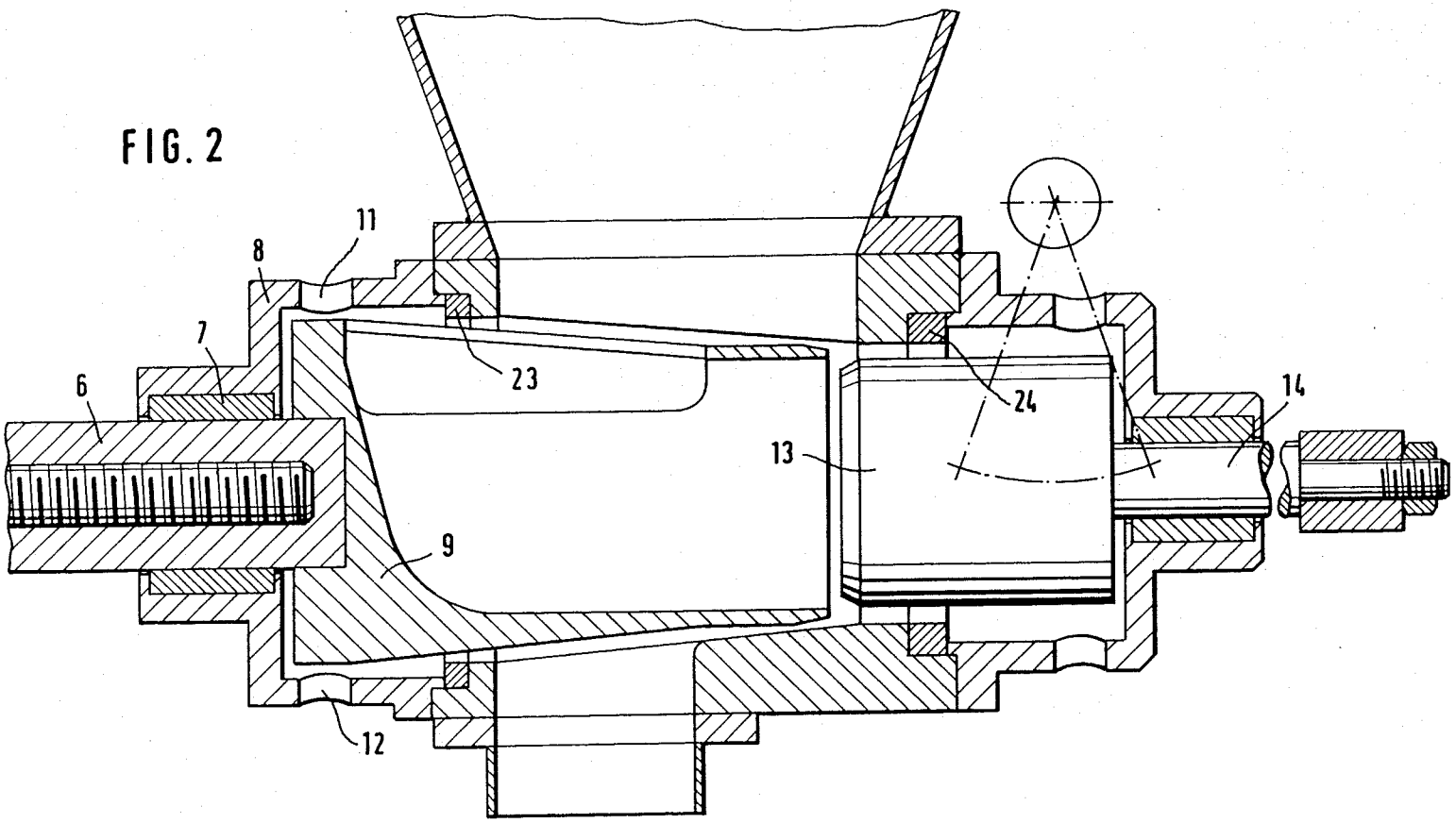
FIG. 2 is a corresponding longitudinal sectional view of the filling arrangement in a cleaning position.

FIG. 2 illustrates the filling arrangement when it is in its cleaning position. In such position the rotating cylinder 9 has been moved leftward via the trunnion pin 6, so that about one quarter of the rotatable cylinder is disposed within the support member 8. There is, however, provided between the bottom side of the rotatable cylinder and the support member as well as between the peripheral surface of the support member 8 at all times a sufficient distance so that the cleaning fluid, which is introduced by way of the inlet opening 11, can universally rinse the rotatable cylinder 9 in a thorough manner, which cleaning fluid exits again from the dosing arrangement by way of the outlet opening 12. If the dosing piston is moved into the position illustrtated in the dot-dash line, then there can be introduced cleaning fluid via the inlet 18 of the other support member 17 which then universally rinses in a thorough manner the dosing piston, whereafter this rinsing cleaning fluid can flow out again via the outlet opening 19. In FIG. 2 there is illustrated that in the cleaning position the dosing piston 13 and the rotatable cylinder 9 have completely disengaged from each other and are spaced apart so that also the end face of the dosing piston 13 and the inner wall 21 of the rotatable cylinder 9 can be optimally cleaned without having to disassemble any parts of the device.

It is, of course, understood that the invention is not limited to the illustrated embodiment, but that in the frame work of the scope of the claims modification to the device are intended to be included. It is basically possible to provide two window-like openings in the rotatable cylinder, whereby one opening functions as an inlet and the other as an outlet. In such a modified construction the outlet is displaced 90° from the inlet, so that the rotatable cylinder 9 needs only to be pivoted about 90° for the purpose of receiving the filling material via the inlet opening 2 and deliver it via the outlet opening 3.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An improved device for dosingly filling of fluid or pasty material into containers, including a housing having an inlet and an outlet for said filling material, a cylinder rotatably mounted in said housing for alternately blocking and unblocking said inlet and outlet, said cylinder having at least one window-like opening in its cylindrical peripheral surface, said cylinder having a free end and, being coaxially mounted on a trunnion pin which is axially slidably and rotatably mounted in a first support and a dosing piston being coaxially mounted on a piston rod which is axially reciprocally slidably mounted in a second support, the improvement comprising in combination, said dosing piston being guidingly contacted by at least a portion of the inner wall surface of said cylinder and being axially slidably movable therein, said piston rod being adapted to slidably move said dosing piston into an extreme inner position and an extreme outer position with respect to said cylinder, said piston blocks at least a third of said window-like opening of said cylinder by means of the peripheral cylindrical surface of said dosing piston when in said extreme inner position and completely exposes said window-like opening when in said extreme outer position in which position said dosing piston is slidably mounted in the region of said free end of said cylinder, said inlet of said housing and said window-like opening in said cylinder being substantially of the same size, the free end of said dosing piston being essentially in alignment with one edge of said inlet and window-like opening when in said extreme outer position.

2. The improvement in a device for dosingly filling of fluid or pasty material into containers as defined in claim 1, wherein in said extreme inner position said peripheral cylindrical surface of said dosing piston blocks about 50% of the inlet of the housing and about 50% of the window-like opening of the cylinder and wherein in the inner extreme position of the piston rod the free end face of the piston is disposed within cross-sectional area defined by the edges of the window-like opening and within the inlet opening cross-sectional area which is about the same size as the cross-sectional area of the window-like opening.

3. The improvement in a device for dosingly filling of fluid or pasty material into containers as defined in claim 2, wherein the cross-sectional area of the window-like opening and the cross-sectional area of said inlet opening are larger than the cross-sectional area of said dosing piston taken in an axial plane.

4. The improvement in a device for dosingly filling of fluid or pasty material into containers as defined in claim 3, wherein the cross-sectional area of said dosing piston taken in a radial plane is about the same size as the cross-sectional area of said outlet opening.

5. The improvement in a device for dosingly filling of fluid or pasty material into containers as defined in claim 4, wherein the axial length of said dosing piston is about half as long as the axial length of said rotating cylinder.

6. The improvement in a device for dosingly filling of fluid or pasty material into containers as defined in claim 5, wherein said first support include synthetic bearing means for rotatably and slidably and sealingly supporting said rotatable cylinder.

7. The improvement in a device for dosingly filling of fluid or pasty material into containers as defined in claim 6, wherein said rotating cylinder has a peripheral cylindrical surface which is supported by said synthetic bearing means and a frusto-conically shaped surface disposed between said synthetic bearing means.

8. The improvement in a device for dosingly filling of fluid or pasty material into containers as defined in claim 7, wherein said first and second supports respectively for said trunnion pin and said piston rod are operatively mounted at opposite axial ends of said housing.

9. The improvement in a device for dosingly filling of fluid or pasty material into containers as defined in claim 8, including cleaning fluid means, said rotatable cylinder being axially reciprocally slidably movable in said housing between an operative production position and an inoperative cleaning position, about one fourth of the axial length of said rotatable cylinder, when in said cleaning position, being disposed inside said first support and the free end of said rotatable cylinder which is remote from said trunnion pin being axially spaced from said dosing piston, said first support including inlet and outlet means for said cleaning fluid means.

10. The improvement in a device for dosingly filling of fluid or pasty material into containers as defined in claim 9, wherein said dosing piston can be fully retracted from said extreme inner position into an extreme outer position by said piston rod, said piston being essentially disposed inside said second support in said fully retracted position, said second support including inlet and outlet means for said cleaning fluid means.

11. The improvement in a device for dosingly filling of fluid or pasty material into containers as defined in claim 10, wherein respectively annular gaps are defined between said dosing piston and second support on the one hand, and said cylinder and first support, on the other hand.

* * * * *